US009687722B2

(12) United States Patent
Kennedy

(10) Patent No.: US 9,687,722 B2
(45) Date of Patent: Jun. 27, 2017

(54) HYDRATION MOUTHPIECE

(71) Applicant: Brett Kennedy, Midland, TX (US)

(72) Inventor: Brett Kennedy, Midland, TX (US)

( * ) Notice: Subject to any disclaimer, the term of this patent is extended or adjusted under 35 U.S.C. 154(b) by 0 days.

(21) Appl. No.: 14/644,204

(22) Filed: Mar. 11, 2015

(65) Prior Publication Data

US 2016/0263465 A1 Sep. 15, 2016

(51) Int. Cl.
*A61C 5/14* (2006.01)
*A63B 71/08* (2006.01)

(52) U.S. Cl.
CPC ..... *A63B 71/085* (2013.01)

(58) Field of Classification Search
CPC ..... A63B 71/085; A63B 2071/086
See application file for complete search history.

(56) References Cited

U.S. PATENT DOCUMENTS 2,669,988 A * 2/1954 Carpenter ..... A61B 1/24 128/861
4,815,893 A * 3/1989 Feder ..... B63C 11/02 128/202.15
6,283,344 B1 * 9/2001 Bradley ..... A42B 1/24 222/175
6,446,628 B1 * 9/2002 Chen ..... A45F 3/20 128/200.24
7,004,172 B1 * 2/2006 Zacco ..... A61F 5/566 128/848
8,931,488 B2 * 1/2015 Evans ..... A63B 71/085 128/859
2005/0242130 A1 * 11/2005 Yang ..... F16K 15/147 222/490
2010/0006109 A1 * 1/2010 McGinnis ..... A63B 71/085 128/861
2012/0219926 A1 * 8/2012 Sullivan ..... A61C 17/0211 433/80
2013/0068854 A1 * 3/2013 Miracle ..... A47G 21/18 239/33
2015/0258417 A1 * 9/2015 Rodgers ..... A63B 71/085 128/861

* cited by examiner

*Primary Examiner* — Kristen Matter
(74) *Attorney, Agent, or Firm* — Warren V. Norred; Norred Law, PLLC

(57) ABSTRACT

The invention is a mouthpiece that is connected to a tube connected to a bladder or liquid reservoir. The mouthpiece is constructed to remain comfortably in a user's mouth during sporting events or other activities, allowing the user to easily and effectively hydrate without distraction, and allowing the user to have both hands available.

10 Claims, 6 Drawing Sheets

HYDRATION MOUTHPIECE

TECHNICAL FIELD OF THE INVENTION

The field of the invention concerns a mouth protection piece that has the means to attach to a source of hydration.

BACKGROUND OF THE INVENTION

There are a variety of physical activities that require some form of protection of the mouth and teeth. These activities usually run a risk of damaging the mouth when it comes to collisions or accidents that would happen during said activities.

These forms of protection, i.e. mouthpieces or "mouth guards", are normally very bulky means of providing maximum protection; users struggle to drink while the mouthpiece is inside the user's mouth.

The current standard mouthpieces/bite valves attached to tubes used for water bladders are not designed to continuously stay in the user's mouth. They slip out easily from the user's mouth, cause distractions, and users tend to cease using them while exercising, so they are forgotten, resulting in no hydration.

The invention discloses a mouthpiece that allows the user to attach a hose from a liquid reservoir, water pouch, bladder or a CamelBak® type of apparatus to the mouthpiece for easy water access.

The CamelBak and similar devices use a mouthpiece that includes a "bite valve" which opens while a user is biting on the end of the tube. This element of the CamelBak product helps keep the liquid from lowering back into the bladder between the user's sips. However this construction means that a user tends to release the CamelBak mouthpiece between sips, because the valve is not designed to remain in the user's mouth at all times.

SUMMARY OF THE INVENTION

The invention described here allows the user to safely place the mouthguard into the mouth, and easily and effectively hydrate for the remainder of a physical activity, reducing the effort necessary to keep the water accessible, and allowing the user to have both hands available and allow the user to focus his attention on other tasks.

The invention comprises a barbed tube intake and mouthpiece. The barbed tube intake accepts a tube that is attached to a water bladder. The mouthpiece is shaped to fit comfortably in a user's mouth with minimal effort on the part of the user for long periods of time. This invention makes it simpler for someone wearing a mouthguard to hydrate. For example, if there is a cyclist in a race and is wearing a water reservoir pack, this cyclist can easily hook the tube of the reservoir pack bladder to the invention and drink without removing the mouthpiece between sips, reducing distractions and increasing his performance.

DETAILED DESCRIPTION OF THE INVENTION

While the making and using of various embodiments of the present disclosure are discussed in detail below, it should be appreciated that the present disclosure provides many applicable inventive concepts, which can be embodied in a wide variety of specific contexts. The disclosure is primarily described and illustrated hereinafter in conjunction with various embodiments of the presently-described systems and methods. The specific embodiments discussed herein are, however, merely illustrative of specific ways to make and use the disclosure and do not limit the scope of the disclosure.

DETAILED DESCRIPTION OF THE INVENTION

This hydration mouthpiece allows users to drink fluids through a hose attached to a fluid source without removing the mouthpiece between sips, as it is designed to remain in a user's mouth for long periods of time.

As seen in the figures, the invention comprises an Intake 13 and a Mouthpiece 15.

The Intake 13 comprises a Tube Connector 31 and a Flat Tube 17 which extends through the Mouthpiece to convey fluid into a user's mouth. The current embodiment comprises a Barbed Tube Connector 31 which creates a friction attachment to the typical elastomeric or silicon tube which sports bladders employ.

Figure 2:
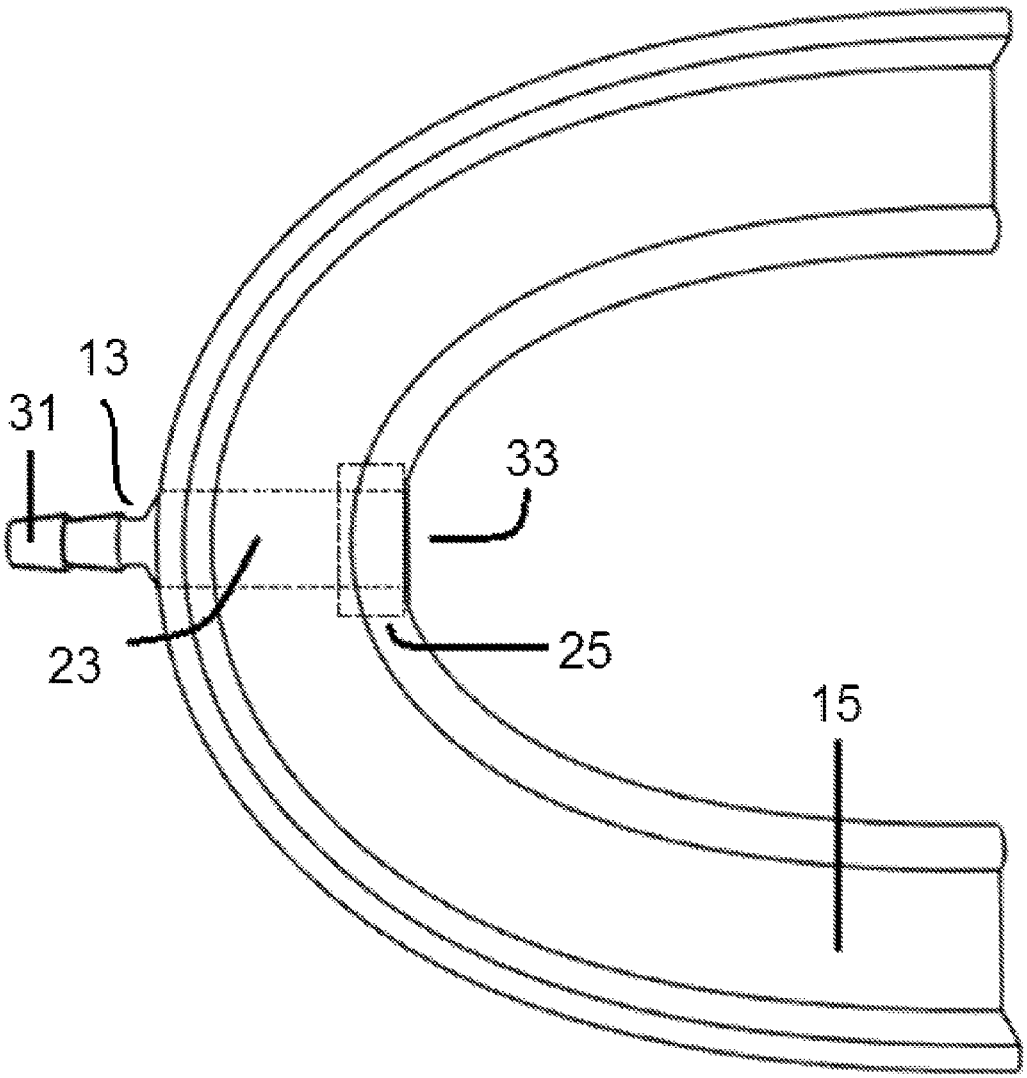
FIG. 2 Top view of the invention as embodied in FIG. 1.
Figure 3:
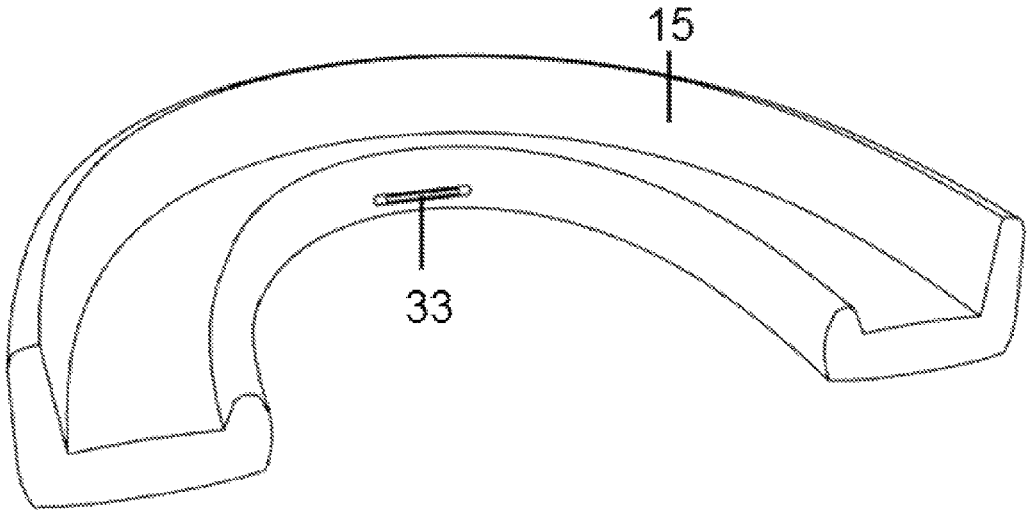
FIG. 3 Rear view of the invention as embodied in FIG. 1.
Figure 4:
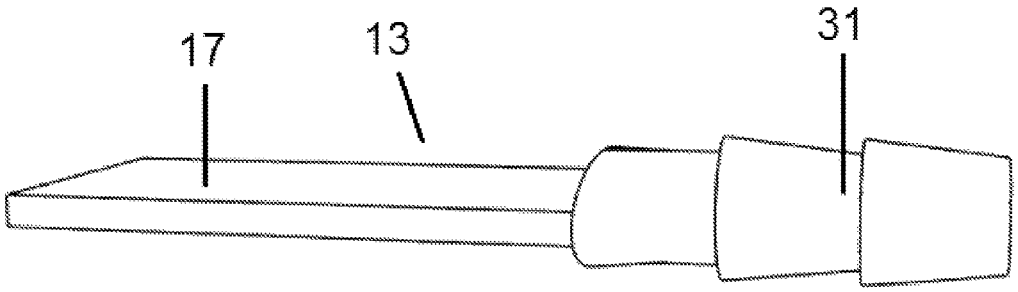
FIG. 4 Side view of one embodiment of the Intake.
Figure 5:
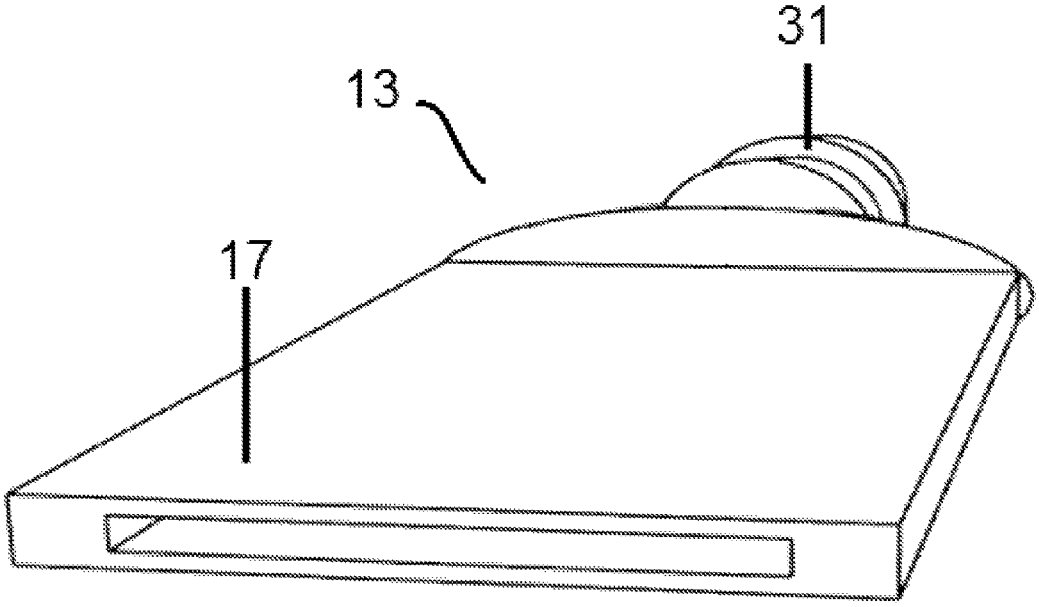
FIG. 5 is an orthogonal rear view of one embodiment of the invention.

As shown by FIG. 2, the Intake 13 fits in a Cavity 23 shaped for it inside the Mouthpiece 15. The Mouthpiece 15 is shaped to fit comfortably in a user's mouth with minimal effort on the part of the user for long periods of time.

As seen in the figures, the Intake 13 serves as a path to convey fluid from the bladder tube to the user, connecting to the bladder tube by the Barbed Tube Connector 31, through the Intake Tube 17, and then through the Internal Mouthpiece Opening 33, inside a user's mouth while it is mounted inside the Mouthpiece 15.

The Intake 13 can also be affixed to a bladder tube in other ways than the barbed construction shown in FIGS. 1-5, though this approach is the best embodiment for those already using a conventional liquid bladder in sporting applications. However, in more rigorous applications, the Intake could include a threaded connection to the bladder tube, as shown in FIG. 6.

Figure 6:
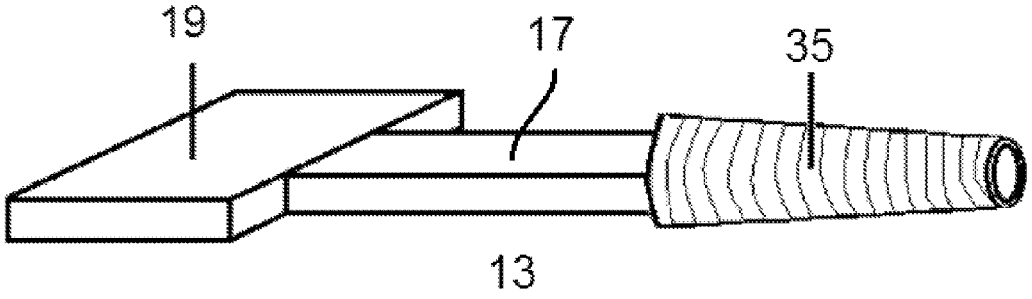
FIG. 6 is an orthogonal view of a second embodiment of the Intake.

Also shown in FIG. 6 is an alternate construction for the Intake 13 that includes a Latch 19 on the end of the Intake that fits into the Mouthpiece 15. FIG. 2 includes an outline of the (non-latch) Regular Cavity 21 that matches the Intake 13 of FIGS. 4 and 5, along with the optional second outlined Latching Cavity 25 which matches the Intake 13 shown in FIG. 6.

Though the construction of the Latch 19 is rectangular in the figures, the invention is not limited to that shape. The point of the Latch 19 is to keep the Intake 13 from slipping out of the front of the Mouthpiece 19 by providing an anchor in the Mouthpiece 15.

The Mouthpiece 15 can be constructed in several ways. In one embodiment, the use of the Latch 19 at the end of the Intake 13 requires that the material used to create the Mouthpiece 15 be flexible enough that the Mouthpiece 15 can stretch to allow the insertion of the Intake 13, which in the current embodiment is constructed of much harder plastic, into the cavity of the Mouthpiece 15.

In a second embodiment plastic injection process is used in which the Intake 13 is molded and then set in a second mold which uses softer plastic to create the Mouthpiece 15. The approach effectively creates a one-piece product that is very rugged and not easily disassembled.

In the current embodiment, the invention is assembled by inserting the Intake 13 into the Internal Mouthpiece Opening of the Mouthpiece 15. But as previously mentioned, the invention is not limited to this type of construction and assembly.

Though the Intake 13 and the Mouthpiece 15 are described here as two different elements, a manufacturer could make a single part that includes both elements as one single formed part. The inventors of this product believe that there are benefits to a two-part construction, as a user will be more comfortable if the Mouthpiece Body has a lower durometer (more elastic) and allows a user's teeth to clasp the mouthpiece naturally either with or without a custom, "boil and bite" fit.

The Intake 13, however, must be hard enough to hold the bladder tube in place without danger of it slipping off. Because the two parts are designed for different tasks, the current embodiment uses two different types of materials and constructed separately but can be molded together by overmolding through thermoplastic injection as discussed supra.

In spite of the above, a manufacturer could form the device as one piece to save construction steps and reduce costs.

Because the Mouthpiece 15 remains in the user's mouth, the need for a bite valve is reduced, because the connection between the user and the tube is maintained naturally. When the user's mouth is closed, liquid inside the bladder tube cannot easily be replaced by air, since the user's mouth will tend to remain closed. However, the Intake 13 can be constructed of softer durometer material, so the natural force of a user's mouth closes the fluid path unless the user is actively intending to suck fluid out of the bladder.

The invention as described and shown is constructed of two components, the Mouthpiece 15 and the Intake 13. However, the invention can be created and constructed with one piece. In such a construction, FIGS. 1, 2, and 3 remain correct, except that no cavity for the Intake 13 is required, because the Intake 13 is simply part of the Mouthpiece 15.

Figure 1:
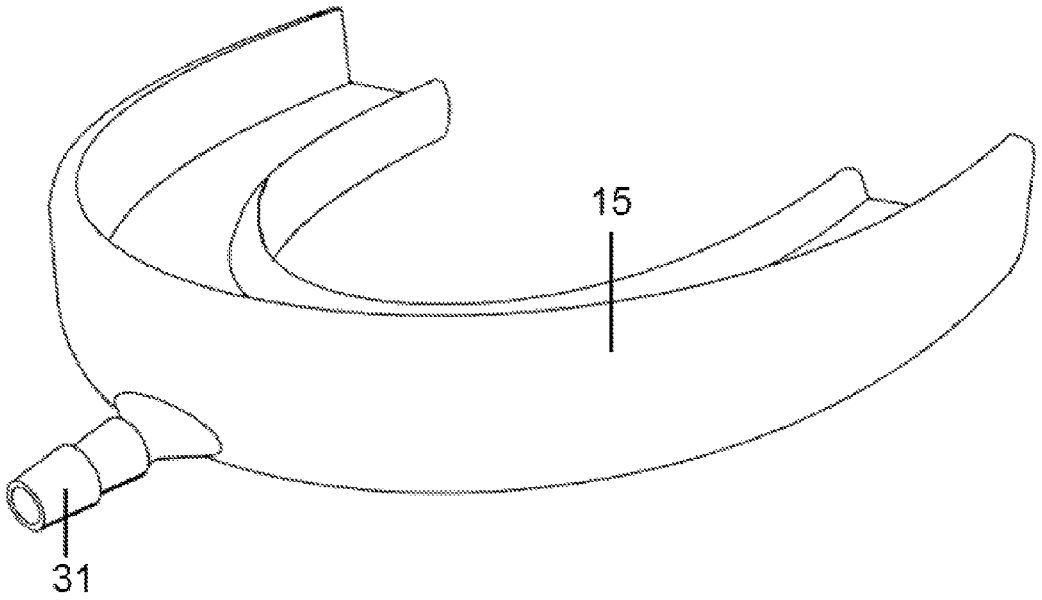
FIG. 1 Orthogonal view of the invention.

Though FIG. 1 shows the invention to have an engagement with the upper teeth, the invention could engage the upper and lower teeth, similar to a boxing mouth guard.

Additionally, the invention could be comprised of multiple components, with the Mouthpiece 15 constructed of a lower half and an upper half, with the Intake 13 an inherent part of one of the halves, or even a three-part construction with the Intake 13 separate, and the upper and lower halves of the Mouthpiece 15 snapping together to hold the Intake 13 in place, and all three components replaceable.

Though the figures reflect a straight connection between the Tube Connector 31 and Intake 13, the elements are not required to be in the same horizontal plane. These two elements can connect at any angle.

| Legend: |
|---|
| 13-Intake |
| 15-Mouthpiece Body |
| 17-Intake Tube |
| 19-Latch |

-continued

| Legend: |
|---|
| 23-Cavity |
| 25-Latching Cavity (alternate) |
| 31-Barbed Tube Connector |
| 33-Internal Mouthpiece Opening |
| 35-Threaded Tube Connector |

The inventor claims:

1. A hydration mouthpiece configured to connect, to a bladder containing liquid for a user to drink comprising:

an internal mouthpiece configured to fit inside the user's mouth between upper and lower teeth, the internal mouthpiece comprising an exterior side adapted to face away from the user and an interior side adapted to face an interior of the user's mouth;

a biting surface configured to employ the user's incisor teeth to hold the internal mouthpiece in place while the user's mouth is closed and at rest; and an intake tube connected to the internal mouthpiece and comprising a fluid path for delivery of the liquid, the intake tube mounted in and extending through the internal mouthpiece, the intake tube comprising an external end adapted to protrude beyond the user's teeth and outside the mouth and an internal end adapted to remain inside the user's mouth, the external end configured to connect to a drinking tube that is connected to the bladder, the intake tube being made from a material configured for allowing force created when the user's mouth is closed and at rest with the internal mouthpiece inserted in the user's mouth to close the fluid path in order to prevent the liquid from passing through to the user.

2. A hydration mouthpiece as in claim 1 in which the internal mouthpiece and intake tube are constructed both of one material and requires no assembly.

3. A hydration mouthpiece as in claim 1 in which the internal mouthpiece and intake tube are constructed of two different materials and in two pieces, but assembled so the intake tube is mounted in the mouthpiece before use.

4. A hydration mouthpiece as in claim 1 in which a durometer of the internal mouthpiece is less than a durometer of the intake tube.

5. A hydration mouthpiece as in claim 1 in which the exterior end of the intake tube comprises a barbed tube fitting connector for dosed fluid communication.

6. A hydration mouthpiece as in claim 1 in which the exterior end of the intake tube comprises a threaded connection connector for closed fluid communication.

7. A hydration mouthpiece as in claim 1 in which the intake tube is mounted to the internal mouthpiece by inserting it through a cavity in the internal mouthpiece.

8. A hydration mouthpiece as in claim 1 in which the intake tube is mounted into the internal mouthpiece only by inserting it into a cavity in the internal mouthpiece from the interior side of the internal mouthpiece.

9. A hydration mouthpiece as in claim 1 in which the intake tube is shaped to fit within a cavity in the internal mouthpiece, so that the intake tube is constructed to be removed from the interior side of the mouthpiece.

10. A hydration mouthpiece as in claim 1 in which the internal and external ends of the intake tribe are not in the same horizontal plane.

* * * * *